United States Patent [19]

Stanton

[11] 3,942,699

[45] Mar. 9, 1976

[54] BOX STITCHING APPARATUS

[75] Inventor: Stephen Stanton, Baltimore, Md.

[73] Assignee: Precision Industries, Inc., Baltimore, Md.

[22] Filed: Oct. 2, 1974

[21] Appl. No.: 511,498

[52] U.S. Cl. ..... 227/3
[51] Int. Cl.[2] ..... B27F 7/06
[58] Field of Search ..... 227/3

[56] References Cited

UNITED STATES PATENTS

| | | | |
|---|---|---|---|
| 3,664,564 | 5/1972 | Stanton et al. | 227/3 X |
| 3,747,827 | 7/1973 | Stanton et al. | 227/3 |
| 3,758,015 | 9/1973 | Stanton | 227/3 |

*Primary Examiner*—Granville Y. Custer, Jr.
*Attorney, Agent, or Firm*—Lerner, David, Littenberg & Samuel

[57] ABSTRACT

A box stitching machine is disclosed which includes a stitching head and a set of pull rollers for intermittently moving a box to be stitched past the stitching head. An operating motor drives a shaft which is connected to the pull rollers through a clutch brake combination. Logic circuitry is disclosed which is responsive to a pair of photocells for starting and stopping operation of the stitching head; a manual switch for adjusting the desired spacing between stitches applied by the stitching head and a plurality of photocells for finely adjusting the stitch spacing.

2 Claims, 3 Drawing Figures

BOX STITCHING APPARATUS

FIELD OF THE INVENTION

This invention relates to box stitching machinery and paticularly to a box stitching machine which can be employed to stitch various size and weight boxes.

BACKGROUND OF THE INVENTION

Box stitching machines have been in existence for some time which include a stitching head for applying wire stitches to overlapping portions of a box blank passing therebeneath and conveying means for incrementally advancing the box blank past the stitching head. Conventionally, such conveying means have taken the form of cooperating pull rollers which sandwich the box blank therebetween and advance the same through the machine in response to the driving rotation thereof.

At startup, the pull rollers operate at a continuous high rate of speed to initially convey the box blank from the input side of the machine toward the stitching station defined by the stitching head. When the box blank reaches a preselected position with respect to the stitching head, appropriate sensing means (in the form of a mechanical sensing finger or a photocell arrangement) detects the leading edge of the box blank to energize a timer which generates a signal after a fixed interval which starts the operation of the stitching head. The stitching head then begins to apply the first stitch to the box blank positioned therebeneath.

Simultaneously with the operation of the stitching head, a signal is generated to stop the aforementioned pull rollers holding the box blank stationary beneath the head when the first stitch is applied thereto. After the completion of the first stitch, and after the stitch driving means associated with the head has been lifted from the box blank, another signal is generated to start the pull rollers moving again to advance the blank a preselected distance whereupon the pull rollers are again stopped to halt the movement of the box blank to await the application of the next stitch being applied by the now continuously operating stitching head. This cycle of stop and start movement of the box blank and the application of a stitch at the stop or dwell period of the box blank motion continues until a preselected number of stitches have been applied or a predetermined portion of the blank has been stitched. At this point the stitching head is de-energized and pull rollers returned to their earlier mode of continuous operation to rapidly eject the box blank from the stitching machine. In my priorly issued U.S. Pat. No. 3,664,564, an electronically controlled stitching machine is disclosed which places a predetermined number of stitches in a box with predetermined spacing therebetween. It has been found that when heavy boxes have been stitched, either with my above-mentioned machine, or any of the other prior art machines, variations in spacing occur between the stitches.

In my prior U.S. Pat. No. 3,758,015, I disclosed an electronically controlled stitching machine in which the spacing variation of stitches resulting from heavy boxes was overcome by providing a photocell which detected a last stitch position and placed a stitch at that last position without regard to the previous stitch spacing. This system overcame the problem encountered when the last stitch was not sufficiently close to the end of the box to ensure proper fastening. However, an uneven pattern of stitching resulted therefrom.

Therefore, it is an object of this invention to provide a new and improved box stitching machine.

It is another object of this invention to provide a box stitching machine which maintains even spacing between stitches regardless of the weight of boxes being stitched.

BRIEF DESCRIPTION OF THE INVENTION

With these and other objects in view, the present invention contemplates a stitching machine which includes a head for (1) applying fastening means at a predetermined rate to a work piece passing thereby and (2) generating a first control signal at said predetermined rate; apparatus for moving the work piece along a path past the head; apparatus for stopping and starting the moving apparatus in response to the first and a second control signal applied thereto in which a device responsive to the first control signal and a spacing signal generates the second control signal.

In the preferred embodiment the spacing signal is a D.C. voltage which is switched between discreet values for choosing a desired spacing between the stitches. A feedback loop senses the actual spacing and modifies the spacing signal to bring the actual spacing to the desired value.

The preferred embodiment also includes a plurality of photocells mounted upon a rigid bar for measuring the actual spacing of the stitches being applied.

DESCRIPTION OF THE DRAWINGS

For a more complete understanding of the invention, reference can be made to the following detailed description of the invention and drawings in which.

DETAILED DESCRIPTION OF THE INVENTION

Figure 1:
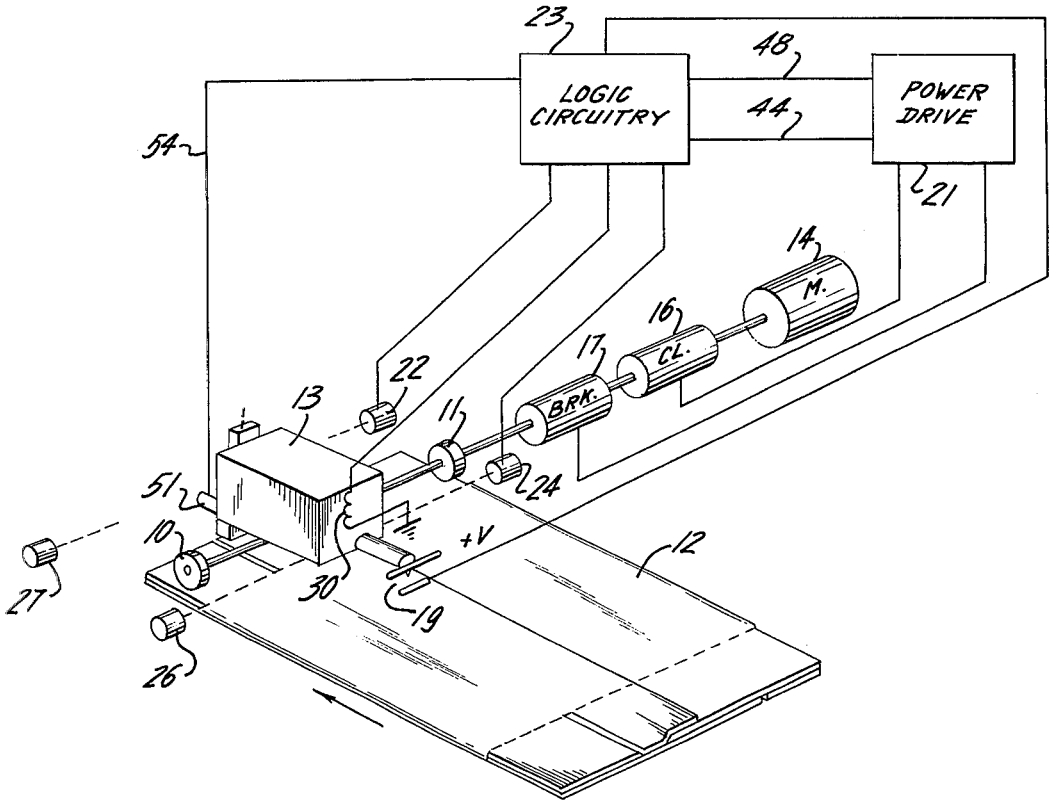
FIG. 1 is a schematic representation partially in block diagram form and partially in isometric showing the organization of a stitching machine constructed in accordance with the teachings of this invention.

Referring now to FIG. 1 we see a diagram showing the basic organization of the machine of this invention. Many of the elements in the machine of FIG. 1 are direct analogies of and organized in an analogous manner to the electronically controlled stitching machine disclosed in U.S. Pat. No. 3,758,015, the disclosure of which is incorporated herein by reference thereto and all disclosures incorporated therein by reference are also incorporated herein by reference. The stitching machine of FIG. 1 has a pair of pull rollers 10 and 11 which move a work piece 10 past a stitching head 13. A motor 14 drives the pull rollers 10 and 11 via a clutch 16 and a brake 17. A power drive unit 21 controls the clutch 16 and brake 17. Signals are applied to the power drive unit 21 via leads 44 and 48 which are driven by logic circuitry 23. The logic circuitry responds to a contact 19 carried by the stitching head 13 as well as photocells 22 and 24 which respond to light from light sources 26 and 27. The logic circuitry also drives a clutch coil 30 in the stitching head 13.

The description thus far corresponds to the machine disclosed in U.S. Pat. No. 3,758,015 with the exception that the logic circuitry 23 herein differs from the logic circuitry in U.S. Pat. No. 3,758,015 and will be described hereinafter in detail.

The machine of this invention also includes, in addition, a photocell bar 51 which also drives the logic circuitry 23. The photocell bar 51 is mounted along the path of travel taken by the portion of the box 12 in which the stitches appear. The photocell bar 51 is to the left of the stitching head 13 in FIG. 1 so that a stitch applied to the box 10 by the stitching head 13 comes to rest under the photocell bar 51 when the brake 17 stops the box 10 for the next stitch to be applied. In particular, if the stitching machine is to provide stitch spacing in a range between ½ and 2 inches, the photocell bar 51 has a first end thereof within ½ inch of the stitching head 13 and extends for at least an additional 1½ inches so that a stitch applied by the stitching head 13 will be beneath the photocell bar 51 when the next stitch is applied to the box 10.

Figure 2:
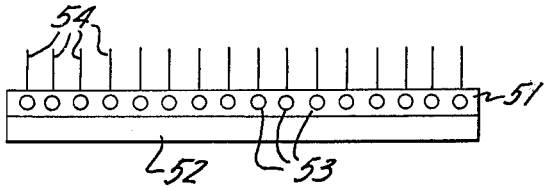
FIG. 2 is a plan view of a photocell bar which forms a portion of this invention.
Figure 3:
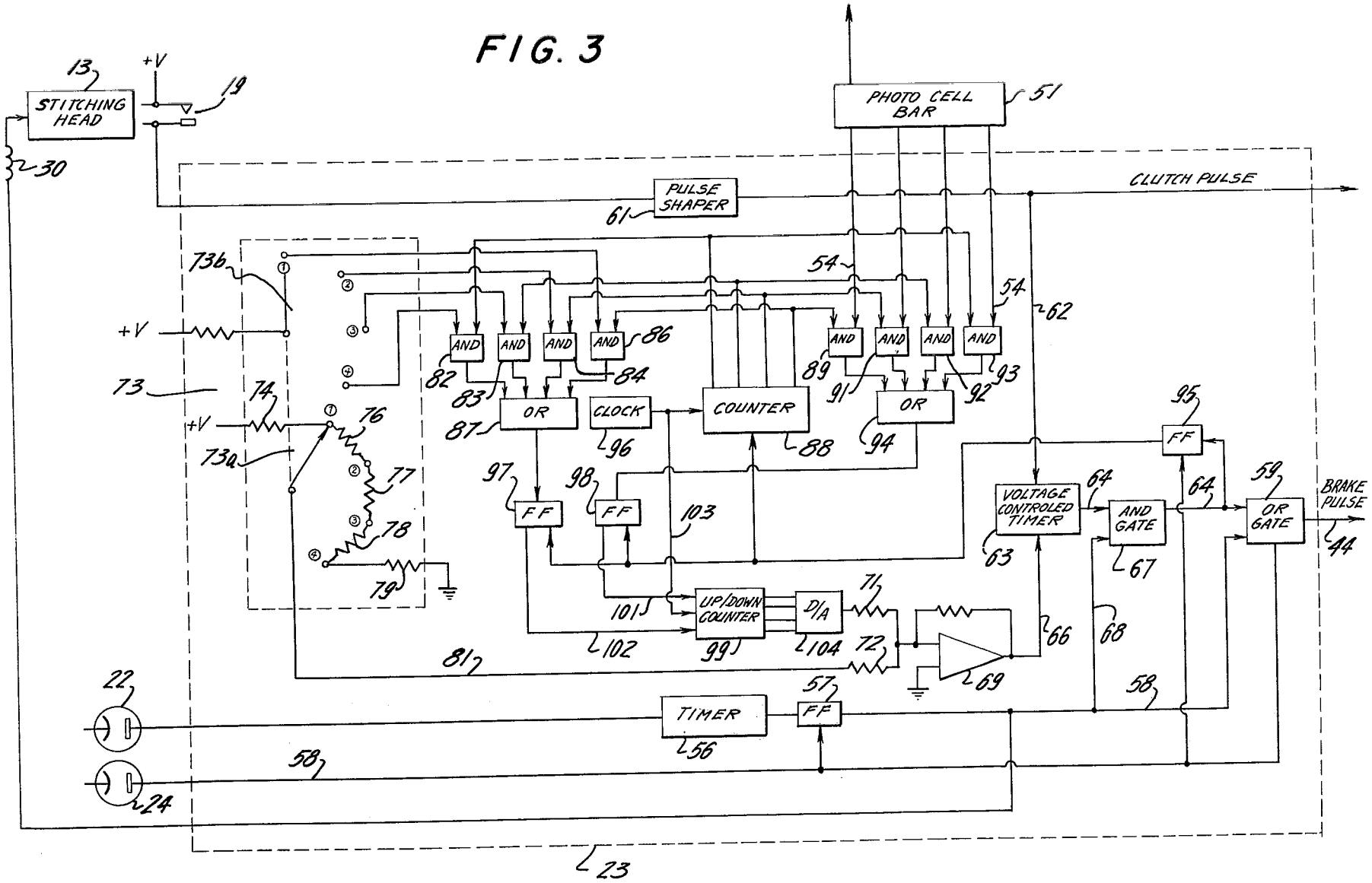
FIG. 3 is a block diagram showing details of logic circuitry for controlling the machine of FIG. 1.

Referring now to FIG. 2, we see the underside of the photocell bar 51. The photocell bar 51 includes an elongated light source 52 for illuminating the box 10 and stitches therein therebeneath. A plurality of photocells 53 are provided in spaced array linearly along the photocell bar 51. In this embodiment the photocells are evenly spaced having a spacing of 1/16 inch therebetween. Each of the photocells 53 have a lead 54 extending therefrom. In operation, the stitching head 13 applies a stitch to the box 12. When the second stitch is applied by the stitching head 13 to the box 10 the first stitch rests under the photocell bar 51. The light from the light source 52 shines upon the box and first stitch. The first stitch reflects light back to the photocells 53. The particular photocell 53 under which the stitch rests is energized providing a signal on the particular lead 54 related thereto. It should be noted that the light bar 51 could also be used in conjunction with the leading edge of the box 12 in order to determine the distance traveled in the first stitch space as well as the previously described method of sensing the position of the staple. In FIG. 1 the leads 54 are shown as a bundle of leads 54 driving the logic circuitry 23.

Referring now to all the Figures, we see that when the stitching machine is started, the box 12 is driven by the pull rollers 10 and 11 until the box 12 interrupts the light from the source 27 providing a signal on photocell 22. The signal from the photocell 22 energizes a timer 56 which activates a flip-flop 57 a predetermined time interval after energization thereof. The flip-flop 57 provides a brake pulse on the lead 44 via lead 58 and OR gate 59 to stop movement of the box 12 a predetermined distance from the leading edge thereof. The flip-flop 57 also actuates the clutch coil 30 of the stitching head 13 thereby beginning continuous operation thereof. If should be noted that the signal from the flip-flop 57 is a D.C. level thereby holding the clutch coil 30 actuated as long as the flip-flop 57 is energized. The OR gate 59 has a differentiating circuit built therein so that when the flip-flop 57 is activated by the timer 56, a single brake pulse is provided on the lead 44.

Operation of the stitching head 13 actuates contacts 19 which have a source of voltage + V connected thereto. At a predetermined point in the cycle of the stitching head 13 a pulse is applied via the contact 19 to a pulse shaper 61 which applies a clutch pulse on the lead 48 thereby reconnecting the motor 14 to drive the pull rollers 10 and 11.

The pulse from the pulse shaper 61 is also applied by a lead 62 to a voltage controlled timer 63. The voltage control timer 63 provides a pulse on an output lead 64 a predetermined time after the pulse is applied on the lead 62. The predetermined time is controlled by a voltage applied on a lead 66. The pulse applied by the voltage control timer 63 on the lead 64 is passed by an AND gate 67 to the OR gate 59 to provide brake pulse on the lead 44. Therefore, it can be seen that the stitch spacing in the box 10 is determined by the predetermined time of the timer 63.

It should be noted that the flip-flop 57 provides another input via lead 68 to the AND gate 67. When the flip-flop 57 is in a state which energizes the stitching head 13 the AND gate 67 is enabled by the flip-flop 57 to pass signals provided by the voltage control timer 63.

The voltage on the lead 66 which determines the predetermined time of the timer 63, is provided by a summing amplifier 69 which adds signals applied thereto via resistors 71 and 72. In accordance with the teachings of this invention, a signal indicating the desired stitch spacing is provided via the resistor 72, while an adjustment signal is provided via resistor 71. A switch 73 having a first bank **73*a* and a second bank 73*b* is provided for selecting the voltages applied to the resistors 71 and 72.**

The bank **73*a* has a voltage divider formed by resistors 74, 76, 77, 78 and 79 connected thereto to provide a desired voltage to the resistor 72 in accordance with the setting of the switch 73. The voltage applied by the bank 73*a* via lead 81 to the resistor 72 provides a component of the voltage applied by summing amplifier 69 to the lead 66 for determining the time the voltage control timer 63 delays the pulses supplied thereto via lead 62.**

Therefore, it can be seen that the use of the voltage control timer 63, in conjunction with the bank **73*a* of switch 73,** allows for easy adjustment of stitch spacing by varying the time between clutch and brake pulses in a stitching machine of the type described.

A further advantage of using a voltage controlled timer such as the voltage control timer 63 in place of a fixed timer as disclosed in my prior patent, is that signals added to the main signal provided by the bank **73*a* of the switch 73, can be used to finely adjust the stitch spacing. In accordance with a further aspect of this invention, the bank 73*b* of the switch 73 which is ganged with the bank 73*a*, provides a voltage to a predetermined contact in accordance with the setting thereof. It should be noted at this time that the switch 73** is shown with four positions indicating four stitched spacings. However, any number of stitch spacings can be employed but four have been shown here for convenience in the drawings. It should be noted that in all likelihood a larger number would be employed but showing additional positions would not aid in a further understanding of the invention.

Each of the contacts (1 through 4) of the bank **73*b* of the switch 73 is connected to an AND gate 82, 83, 84 and 86. The outputs of the AND gates 82, 83, 84 and 86 are each connected to an OR gate 87. Each of the AND gates 82, 83, 84 and 86 have as a second input thereof, an output from a counter 88.**

In a like fashion, each of the output leads 54 of the photocell bar 51 are connected to an AND gate 89, 91, 92 and 93 respectively. The outputs of the AND gates 89, 91, 92 and 93 are each connected to an OR gate 94. An output from the counter 88 is connected as an input to each of the AND gates 89, 91, 92 and 93. Therefore, and AND gate 82 has as an input thereof, the same output of the counter 88 as does and AND gate 89. In a like fashion the AND gates 83 and 91, 84 and 92, and 86 and 93 are associated by having the same output from the counter 88 connected thereto. The AND gate 89 is connected to a photocell in the photocell bar 51 which corresponds to the position that the first stitch should be in while the second stitch is being applied with the switch 73 in its fourth position. Therefore, the voltage applied to the resistor 72 by the bank 73*a*, with the switch 73 in its fourth position, is adjusted to provide a stitch spacing which will put the first stitch under the photocell associated with the AND gate 79 when the box 10 has been stopped to place the second stitch therein. The counter 88 is driven by a continuously running clock 96 and reset to its zero position when the first brake pulse is provided on the lead 44. This is accomplished by a flip-flop 95 driven by the AND gate 67. Upon resetting of the counter 88 to zero, the clock 86 begins stepping the counter 88 through its position. The flip-flop 95 also resets flip-flops 97 and 98 to their reset positions. The flip-flops 97 and 98 drive an up-down counter 99 which holds its count if the same input is applied to input leads 101 and 102. The up-down counter 99 advances a count if the input on the lead 101 is a one while the input on the lead 102 is a zero. In a like manner if the input on the lead 101 is a zero, and the input on the lead 102 is a one, the up-down counter counts in a downward direction each time a pulse is applied on the lead 103. The output of the up-down counter 99 is applied to a digital to analogue converter 104 which applies an analogue signal to the resistor 71 to provide a component of the signal applied on the lead 66 by the amplifier 69.

Therefore it can be seen when both of the flip-flops 97 and 98 are in their set state, the up-down counter 99 is not affected. In a like manner, when they are both reset simultaneously by the flip-flop 95, the count therein again is not effective. However, as the clock 96 counts the counter 88, a comparison is made between the inputs on the AND gates 82, 83, 84 and 86 with the inputs on the AND gates 89, 91, 92 and 93, respectively. If the first stitch is in its proper position the photocell in the photocell bar 51 will be illuminated when the switch 73 is in a position to energize an AND gate corresponding thereto. Under such circumstances, the OR gates 87 and 94 will be simultaneously energized flipping the flip-flops 97 and 98 simultaneously, again not affecting the count in the up-down counter 99. If, on the other hand, the switch 73*b* is set to energize the AND gate 83 and the stitching machine is providing spacing which is too close, the photocell bar 51 will actuate the AND gate 89 rather than the AND gate 91. When the counter 88 reaches its first count the AND gate 89 having an input from the photocell bar 51 and the counter 88, will energize the OR gate 94 to flip the flip-flop 98. Since the selection switch 73 is not energizing the AND gate 82, the OR gate 87 will not operate to flip the flip-flop 97. On the next count of counter 88, the up-down counter 99 will be incremented to increase its count. At the same time the AND gate 83 will now be energized to actuate the OR gate 87 to flip the flip-flop 97, bringing the up-down counter again to a quiescent position. When the next box 10 is stitched the spacing between the first and second stitch will now be increased by the change in count of the up-down counter 99. If it still is not sufficiently increased to actuate the photocell associated with AND gate 91, rather than the photocell associated with the AND gate 89, the up-down counter 99 will again be incremented.

It is of course seen that if the spacing is too large the flip-flop 97 will be actuated before the flip-flop 98 and the up-down counter will be decreased in count once per stitching cycle.

Therefore it can be seen that a system has been described in which the basic spacing between stitches is controlled by the bank 73*a* of the switch 73 in combination with a voltage control timer 93. It has further been shown that a photocell bar 53, in combination with limited circuitry, can be employed to provide a fine adjustment for the stitch spacing.

The intermittent stitching cycle can be terminated in any of the known ways discussed in my prior patents referred to above, for example, a certain number of stitches can be counted or, as shown here, the photocell 24 can be employed to detect a last stitch position for providing the last brake pulse, resetting the flip-flop 95 and the flip-flop 57. In this way a last stitch is placed in its final position without regard to the actual stitch spacing. If the feedback adjusting circuitry described above is operating and adjusted properly, this will correspond to the normal stitch spacing.

It should be understood that while this invention has been described with respect to a particular embodiment thereof, numerous others will become obvious to those of ordinary skill in the art in light thereof.

What is claimed is:

1. A stitching machine including:

first means for (1) applying fastening means at a predetermined rate to a workpiece passing thereby and (2) generating a first control signal at said predetermined rate;

second means for moving said workpiece along the path past said first means;

third means for stopping and starting said second means in response to said first and a second control signal applied thereto;

fourth means responsive to said first control signal and a spacing signal for generating said second control signal;

said fourth means being a voltage controlled timer;

said stitching machine also including a summing amplifier for providing said spacing signal;

means for generating a predetermined signal indicative of said desired spacing;

means for generating a feedback signal responsive to the actual stitch spacing;

means for applying said predetermined signal to said summing amplifier; and means for applying said feedback signal to said summing amplifier.

2. The stitching machine as defined in claim 1 also including a plurality of photocells mounted in a fixed relationship to each other for providing said feedback signal.

* * * * *